US011365581B2

(12) United States Patent
Wang

(10) Patent No.: US 11,365,581 B2
(45) Date of Patent: Jun. 21, 2022

(54) DOOR FRAME AND A DOOR FRAME COMPONENT THEREOF

(71) Applicant: Nan Ya Plastics Corporation, Taipei (TW)

(72) Inventor: Kuei-Yung Wang, Taipei (TW)

(73) Assignee: NAN YA PLASTICS CORPORATION

( * ) Notice: Subject to any disclaimer, the term of this patent is extended or adjusted under 35 U.S.C. 154(b) by 0 days.

(21) Appl. No.: 16/876,314

(22) Filed: May 18, 2020

(65) Prior Publication Data

US 2020/0277818 A1 Sep. 3, 2020

Related U.S. Application Data

(63) Continuation of application No. 16/874,765, filed on May 15, 2020, now abandoned.

(51) Int. Cl.
*E06B 1/52* (2006.01)

(52) U.S. Cl.
CPC ..... *E06B 1/52* (2013.01)

(58) Field of Classification Search
CPC ..... E06B 1/52; E06B 1/26; E06B 1/28; E06B 1/526; E06B 3/72; E06B 3/725
USPC ..... 52/211, 204.1, 656.4
See application file for complete search history.

(56) References Cited

U.S. PATENT DOCUMENTS

| | | | | |
|---|---|---|---|---|
| 5,182,880 | A * | 2/1993 | Berge, Jr | E06B 1/34 49/460 |
| 5,901,510 | A * | 5/1999 | Ellingson | E06B 1/045 49/504 |
| 10,941,606 | B1 * | 3/2021 | Kendall | E06B 1/524 |
| 2002/0046532 | A1 * | 4/2002 | Rochman | E06B 1/34 52/656.4 |
| 2002/0139071 | A1 * | 10/2002 | Banford | E06B 1/32 52/204.1 |
| 2007/0137120 | A1 * | 6/2007 | Raymond | E06B 1/34 52/211 |
| 2007/0209299 | A1 * | 9/2007 | El Etel | E06B 1/10 52/204.1 |
| 2008/0172956 | A1 * | 7/2008 | Boldt | E06B 1/30 52/204.1 |
| 2019/0242179 | A1 * | 8/2019 | Wang | E06B 3/9632 |

* cited by examiner

*Primary Examiner* — Kyle J. Walraed-Sullivan
(74) *Attorney, Agent, or Firm* — Ostrolenk Faber LLP

(57) ABSTRACT

A door frame and a door frame component thereof. The door frame component includes an elongate body having first and second opposite sides which are structurally distinct from one another; the first side having a door stop which comprises an abutment for engaging by a door; the second side being configured for engaging a wall; and a third side extending across the first and second sides, wherein, a decorative portion is integrally formed on the third side, which extends beyond the second side in a direction away from the door stop such that the decorative portion and the second side embraces adjoining sides of said wall structure.

12 Claims, 4 Drawing Sheets

DOOR FRAME AND A DOOR FRAME COMPONENT THEREOF

CROSS-REFERENCE TO RELATED APPLICATION

The present application is a continuation of U.S. patent application Ser. No. 16/874,765, filed May 15, 2020, the contents of which are incorporated herein by reference.

FIELD OF THE INVENTION

The present invention relates to a door frame component for example particularly, but not exclusively, a door frame component for a fast-fit door frame assembly.

BACKGROUND OF THE INVENTION

Wooden doors are beautiful and sturdy but it falters in comparison to metal or plastic door in its necessity for upkeep. Overtime, wood is prone to warping and rotting. The expenses for maintenance add to the overall costs in having a wooden door.

Owing to the many benefits with, for example, uPVC, CPVC and composite doors, they have become the preferred option for houses and commercial buildings. They are proven to be good solution for affordable and durable doors. However one of the major drawbacks of uPVC doors is the issue of strength and security. They are not as durable and robust as wooden doors. Also, the shape and size is predetermined at manufacture and alteration is not intended.

For a door to function properly, the gap between the door and the frame must be uniform around the entire edge of the door. When the door is jamming, rattling or scraping against the floor or jamb, if left unchecked may lead to bigger problems.

Installation of a door requires exact measuring skills and an understanding of terms and materials. For wooden doors, there will be a need for reasonably well carpentry skills. Conventionally, to install a door, detailed measurements of the doorway are taken. The door frame is sized to fit the doorway and is allowed to adhere to the surrounding walls before the architraves are securely fixed to the door frame. Problems are encountered in fitting the jambs as well as attaching the architrave which are separate parts. The sizes of the jambs are dependent on that of the doorway and the measurements of the architraves are taken based on the doorway and the jambs. Existing door systems often require specialized knowledge or skills to install properly, which may also result in the installation of a door to be done poorly or not done at all. It can be difficult to produce jambs and architraves that tightly fit all corners of a wall, especially with rounded corners and damaged corners. Irregular gaps between the architraves and the jambs allow for accumulation of dirt and the infiltration of water and moisture that speeds up the deterioration of the door frame.

The invention seeks to eliminate or at least to mitigate such shortcomings for simplicity and strength without a substantial increase in costs by providing a new or otherwise improved component of a door frame assembly.

SUMMARY OF THE INVENTION

According to the invention, in a first aspect of the invention there is provided a door frame component for fitting on a wall structure comprising an elongate body having first and second opposite sides which are structurally distinct from one another; the first side having a door stop which comprises an abutment for engaging by a door; the second side being configured for engaging a wall; and a third side extending across the first and second sides, wherein, a decorative portion is integrally formed on the third side, which extends beyond the second side in a direction away from the door stop such that the decorative portion and the second side embraces adjoining sides of said wall structure; Preferably, the decorative portion includes an external surface being furnished for decorative purpose and an internal surface which is structurally configured for engaging said wall structure; More preferably, the second side and the internal surface are adjoined to form an engagement surface configured to match said adjoining sides of said wall structure; Yet more preferably, the engagement surface includes a bent; Advantageously, the bent is a right angle bent; It is preferable that the elongate body and the decorative portion are formed simultaneously by way of extrusion.

It is advantageous that the door stop forms a step on the first surface with the abutment at one end; Yet more advantageously, the abutment comprises an abutment surface that is arranged traversely to the first surface for engagement with a door; Preferably, the door stop includes a slot that extends inwardly from the abutment surface for accommodating a draught bead; more preferably, the slot spans along the entire length of the door stop in a direction substantially parallel to the first side.

It is preferable that the second surface includes a groove that spans along the entire length of the elongate body for retaining water-proof material; Preferably, the internal surface includes a groove that spans along the entire length of the elongate body for retaining water-proof material; It is advantageous that, the elongate body includes a hollow channel which extends along length of the elongate body.

It is preferable that the elongate body and the decorative portion forms an L-shaped one-piece structure with the first surface and the internal surface meet to form a right angle bent.

In a second aspect of the invention, there is provided a door frame comprising first and second door frame components as claimed each with one end being configured for engagement; and a third door frame component as claimed, wherein two engagement ends of the third door frame component are configured for engagement with the first and second door frame components respectively; preferably, the ends of the first and second door frame components, which are configured for engagement, each comprises a chamfer to match with the respective engagement ends of the third door frame component; more preferably, the first door frame component is a mirror image of the second door frame component.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
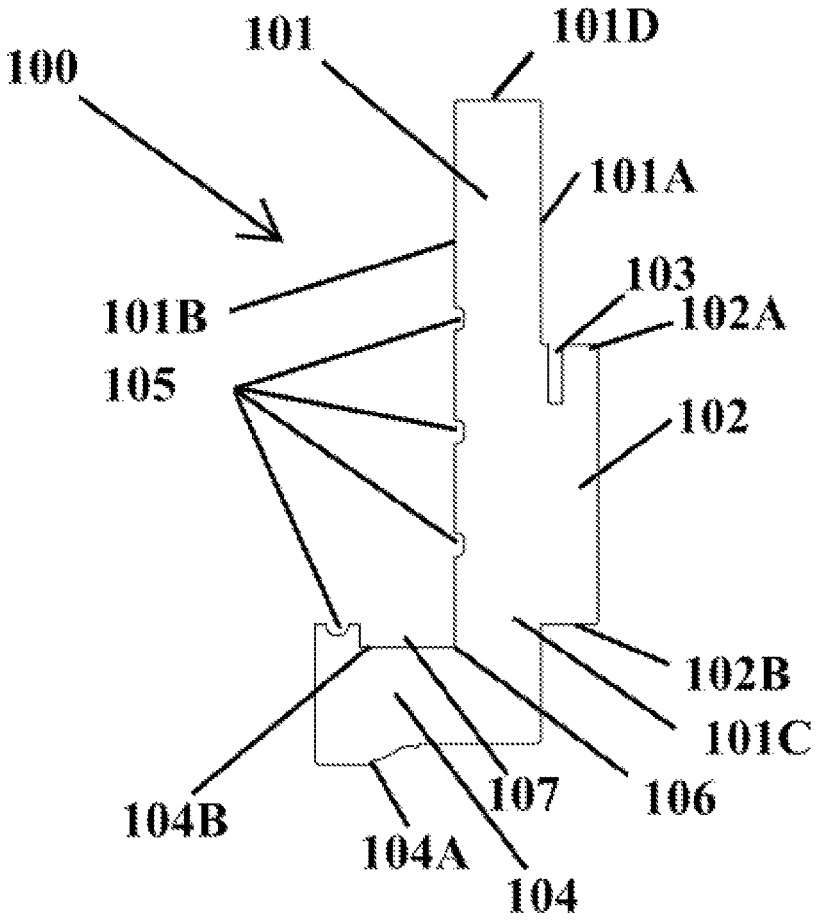
FIG. 1 is a cross-sectional view taken across length of a first embodiment of a door frame component in accordance with the invention.
Figure 3:
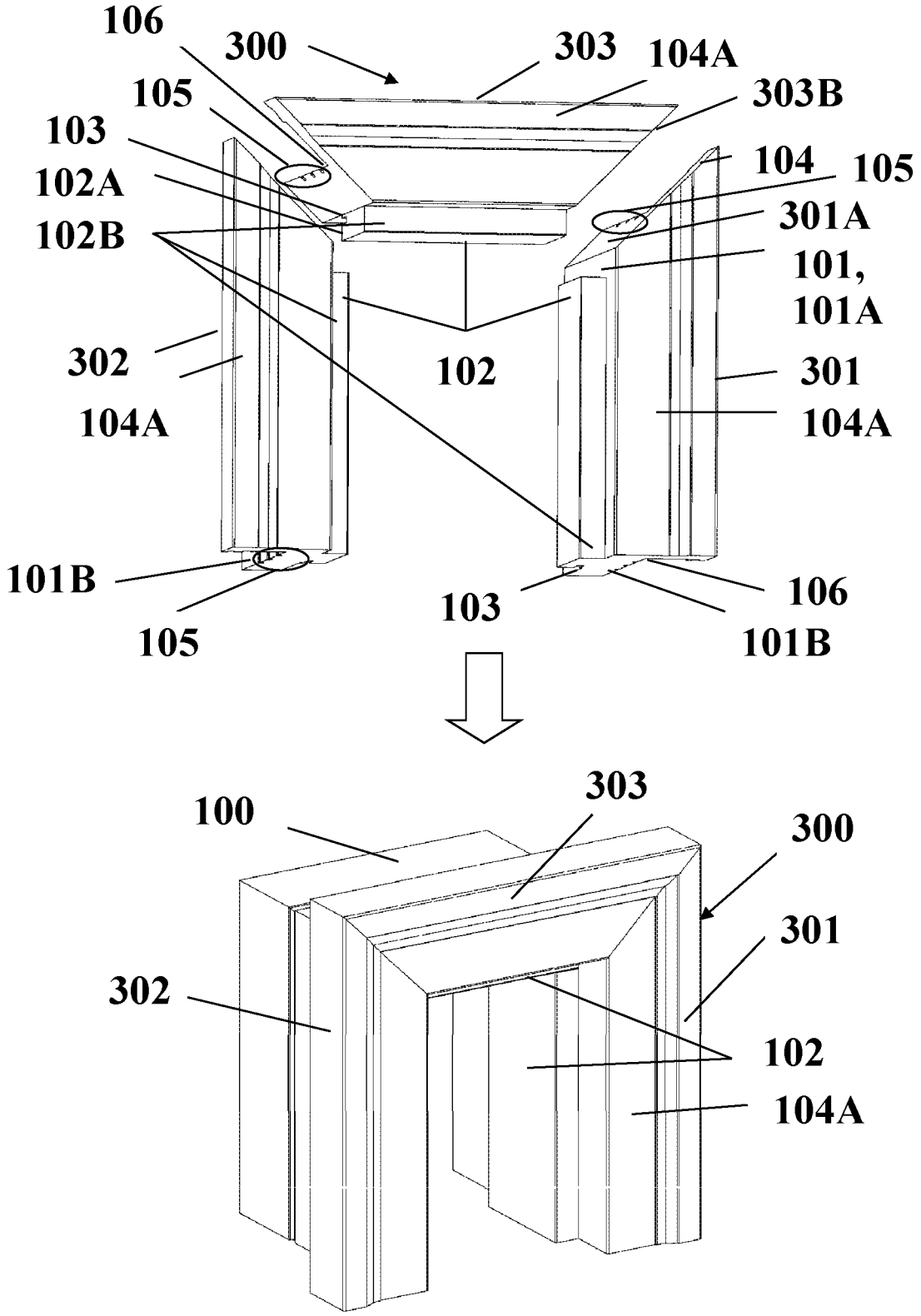
FIG. 3 is an exploded view of a door frame formed from three of the door frame component in accordance with the invention.

Referring to FIG. 1, there is shown door frame component 100 in accordance with the invention. The door frame component 100 engages a corner of a wall structure 200. In the preferred embodiment, three such door frame components 100 together form a door frame 300 in accordance with the invention and as shown in FIG. 3. The installation of such a door frame 300 requires minimum number of steps. Other than the usual preparation and finishing works, the installation of each component 100 is streamlined to a single step.

The door frame component 100 includes an elongate body 101 having four sides, a first side 101A, a second side 101B, a third side 101C and a fourth side 101D. The first and second sides 101A and 101B are the longer sides of the four. They are opposite of each other and are structurally distinct. The fourth side 101D spans across the first and second sides 101A and 101B and forms a free end of the elongate body 101. The third side 101C is opposite of the fourth side 101D and it also extends across the first and second sides 101A and 101B. The elongate body 101 has a generally rectangular cross-section with an even dimension along length. The cross-sectional shape of the elongate body 101 is customizable. Mass production by conventional methods is possible once the preferred shape is determined.

Figure 2:
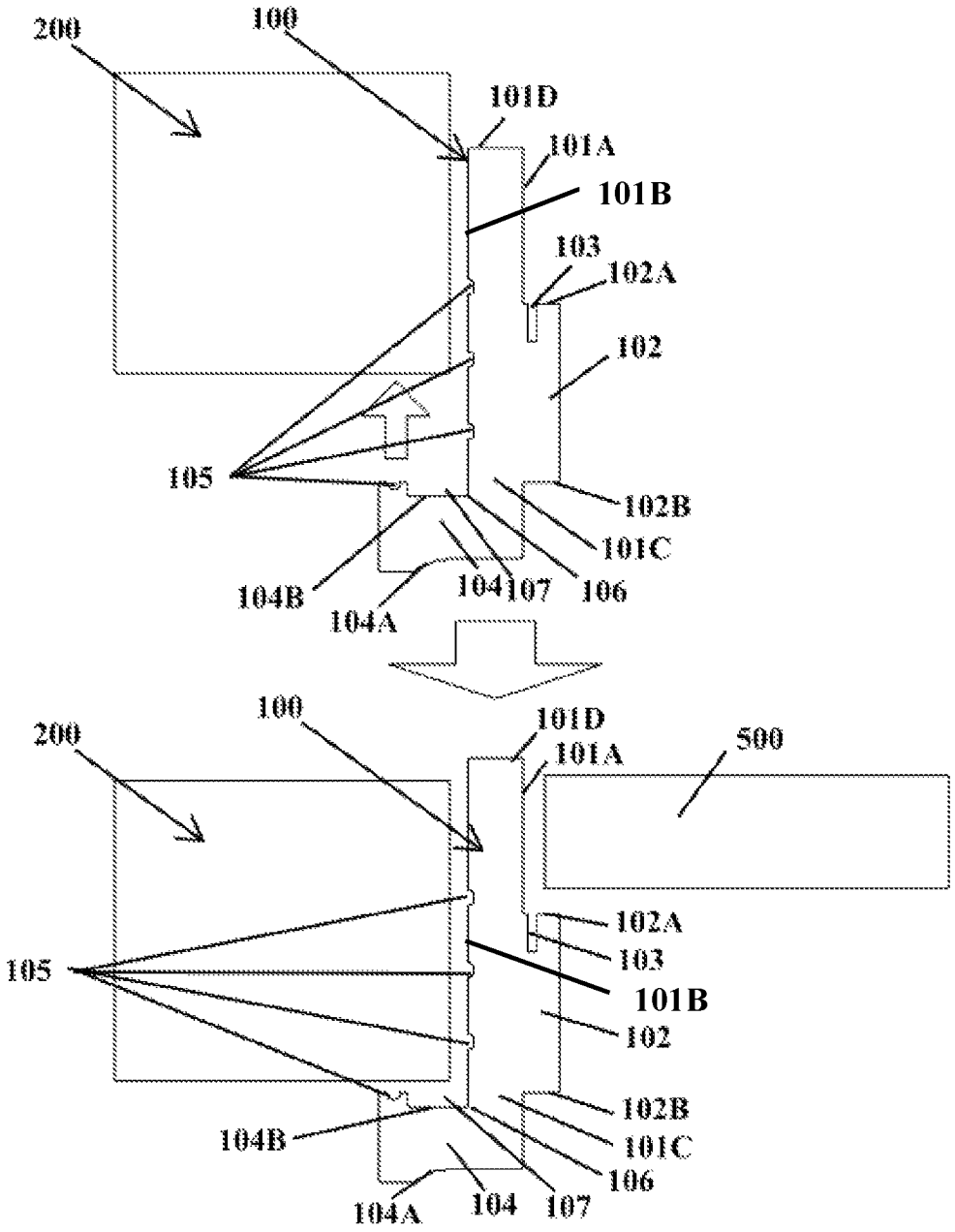
FIG. 2 is sequential schematic illustration of the door frame component in FIG. 1 being installed.

In more detail, with reference to FIGS. 1 and 2, a door stop 102 is provided on and integrally formed with the first side 101A of the door frame component 100 in the form of a step or an extended platform. In the preferred embodiment, the door stop 102 runs parallel to the first side 101A and only covers half thickness thereof. The remaining of the first side 101A is a clearance for accommodating a door 500. The width of the door stop 102 may depend on the thickness of the door 500. The door stop 102 can be of any shapes but preferably in the form of a rectangular step or platform on the first side 101A with has two ends 102A and 102B. One end 102A functions as an abutment for abutting a closed door 500. The other end 102B is a free end that flushes with the third side 101C. The abutment 102A includes an abutment surface arranged traversely to the first side 101A. Such abutment surface 102A forms a right angle with the first side 101A. The abutment 102A may take on different shapes. As an example, the abutment 102A may have a hemispherical cross-sectional shape.

A slot 103 extends from the abutment surface 102A into body of the door stop 102. In the embodiment as shown in FIGS. 1 and 2, the slot 103 is configured to hold and accommodate a draught bead or a weather seal such as Q-Lon. The slot 103 can be formed after the door frame component 100 is made or can be made with the door frame component 100. The dimension of the slot 103 can be customized according to need. In the embodiment as shown in Figures land 2, the slot 103 extends into ¼ of the overall thickness of the door stop 102 and it spans along the entire length of the door stop 102 in a direction substantially parallel to the first side 101A.

A decorative portion 104 is provided on the third side 101C of the door frame component 101. It is an elongate structure that spans along the entire length of the third side 101C. The decorative portion 104 functions as an architrave while the elongate body 101, a jamb.

More specifically, the decorative portion 104 is integrally formed on or to the third side 101C. In the preferred embodiment as shown in FIGS. 1 and 2, it is a rectangular block with an external surface 104A being furnished for decorative purpose and an internal surface 104B which is structurally configured for engaging the wall structure 200. The external surface 104A extends along three sides of the decorative portion 104, two of which being the shorter opposite sides and one being a longer side opposite that of the internal surface 104B. One of the shorter opposite sides flushes with the first side 101A of the elongate body 101 and the other of the shorter opposite sides is a free end. The decorative portion, more specifically the width of the decorative portion, extends in a direction away from the door stop 102 and beyond the second side 101B of the elongate body such that the decorative portion 104 and the second side 101B embraces adjoining sides 201 and 202 of a wall structure 200. The internal surface 104B of the decorative portion 104 and the second side 101B of the elongate body 101 are adjoined to form the inner surface 104B and 101B of the door frame component 100 which is configured to engage adjoining sides of the wall structure 200. An angle is formed between the internal surface 104B and the second side 101B. In the embodiment as shown in FIGS. 1 and 2, the angle is 90 degrees.

The elongate body 101 and the decorative portion 104 forms an L-shaped one-piece structure of the door frame component 100 in accordance with the invention. The inner surface 104B and 101B of the door frame component function as an engagement surface 101B and 104B configured or shaped to match the adjoining sides of said wall structure 200. This engagement surface 101B and 104B includes a bent 106. The bent 106 may be made abrupt and sharp or smooth and round, depending on the shape of the corner of the wall structure 200. In the preferred embodiment, it is a right angle (90 degree) bent.

The internal surface 104B as well as the second side 101B have a plurality of grooves 105. The grooves 105 on the second side 101B run along entire length of the elongate body 100. The groove 105 on the internal surface 104B runs along entire length of the decorative portion 104. These grooves 105 are dimensioned and useful in retaining waterproof material. The waterproof material is for example silicone that fills the groove 105 and forms a barrier with the wall structure 200 to stop water passing. Upon installation, there is a small gap between the wall structure 200 and the door frame component 100. The size of the gap is determined by that of the barrier.

Adjacent the groove 105 and on the internal surface 104B of the decorative portion there is a generally rectangular recess 107. The recess 107 offers some flexibility to the decorative portion 104 to allow for slight deformation of shape, for example, during thermal expansion.

Figure 4:
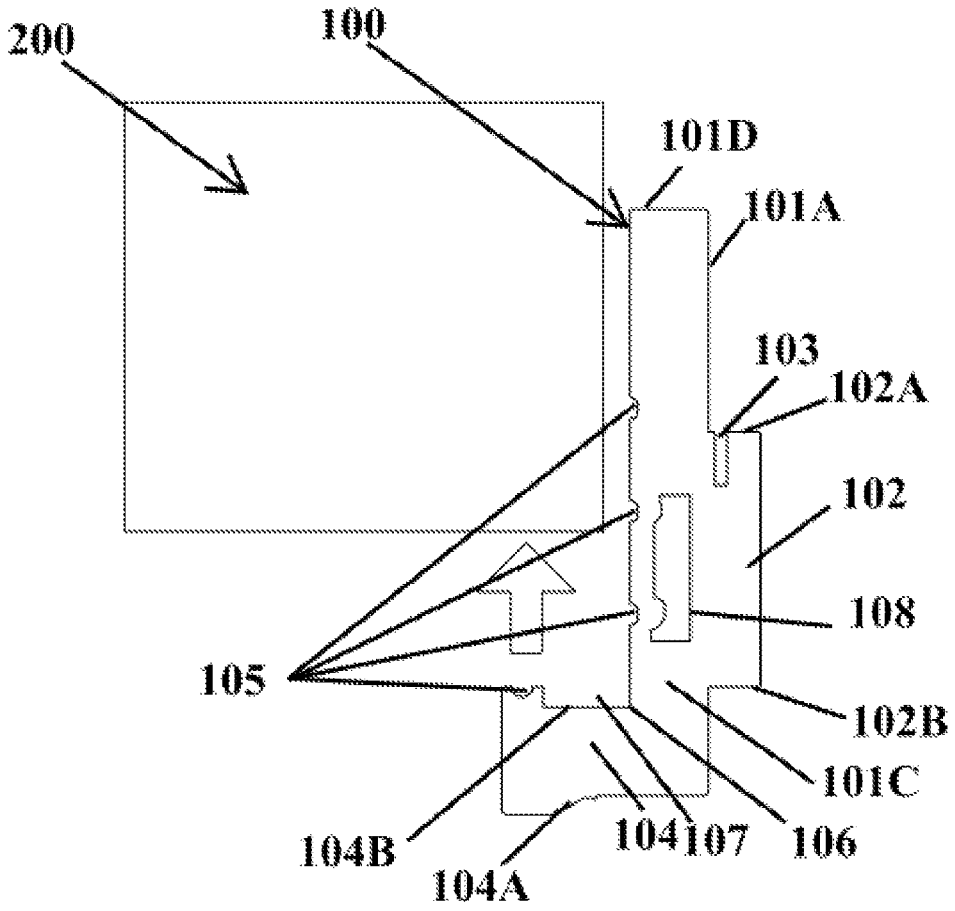
FIG. 4 is a cross-sectional view taken across length of a second embodiment of the door frame component in accordance with the invention.

Referring to FIG. 4, there is shown a second embodiment of the door frame component 100 in accordance with the invention. All features are the same as those in the second embodiment except that it includes one or more hollow channel 108 that extends along length of the elongate body 101. The hollow channel 108 offers further flexibility to the door frame component for allowance of, for example, deformation and adjustment, during thermal expansion when the situation calls for.

The door frame component 100 may be formed from a material selected from a group consisting wood, metal and plastic. A preferred material is PVC (e.g. uPVC, CPVC) and a preferred method of manufacture is extrusion. Another preferred material is composite material. The elongate body 101 and the decorative panel 104 are formed in one-piece simultaneously by extrusion. The bent 106 may be of any shape and can be shaped simultaneously with the formation of the door frame component 100 in the extrusion or is shaped/machined after the door frame component 100 is formed.

With reference to FIG. 3, a door frame 300 may be formed from three of the door frame components 100. In this embodiment, two of the door frame components 301 and 302 are of the same length and are mirror images of one another. These two, first and second, door frame components 301 and 302 are bridged by a shorter and structurally different, third, door frame component 303.

Lower ends of the first and second door frame components 301 and 302 are generally flat for laying on a floor. Upper ends 301A and 302A of the first and second door frame components 301 and 302 are configured to fit with and engage opposite ends 303A and 303B of a third door frame component 303 respectively. As shown in FIG. 3, the ends 301A and 302A each has a chamfer. Corresponding chamfers on the opposite ends 303A and 303B are shaped to fit and engage with the chamfers on the ends 301A and 302A of the first and second door frame components 301 and 302. The chamfers are sloped at 45 degree. The installation of the door frame 300 becomes a relatively easy task, like building a Lego door frame, by putting three matching parts together. The relative positions of the door frame components 301, 302 and 303 are fixed automatically or inherently once the chamfers engage. Screw, adhesive, molten plastic and miter joints may be employed to secure the relative positions of the door frame components 301, 302 and 303.

The dimensions of all parts can be adjusted according to needs on site or at the factory. The invention offers flexibility and simplifies the installation of a door frame substantially.

The invention has been given by way of example only, and various other modifications of and/or alterations to the described embodiment may be made by persons skilled in the art without departing from the scope of the invention as specified in the appended claims.

The invention claimed is:

1. A door frame component configured for constructing a door frame that fits on a wall structure defined by an opening, the wall structure having an interior surface and an exterior surface adjoining the interior surface, the door frame component comprising:

an elongate body, the elongate body having a first side, a second side opposite and spaced from the first side, and a third side extending from the first side to the second side, the first, the second, and the third sides being inseparable from each other to define the elongate body and being structurally distinct from one another;

the first side having an integral door stop arranged to face outward from the wall structure when the first side is arranged on the interior surface of the wall structure, and which comprises an abutment for engaging by a door;

the second side being configured for engaging the interior surface of the wall structure;

a decorative portion configured to engage the exterior surface of the wall structure, the decorative portion extending from the first side and away from the second side of the elongate body, and the decorative portion is shorter in length away from the second side of the elongate body than a thickness of the wall structure, whereby the decorative portion exposes and does not cover a portion of the wall structure that is beyond the second side, such that the decorative portion and the second side of the elongate body respectively embrace the adjoining interior and exterior surfaces of the wall structure when the door frame component is fitted to the wall structure;

the decorative portion includes an external surface arranged to face away from the exterior surface of the wall structure and being for a decorative purpose and the decorative portion includes an internal surface, and a projection extending from the internal surface, the projection being structurally configured for engaging the exterior surface of the wall structure;

the internal surface and the projection defining a recess to offer flexibility to the decorative portion, the recess being located, and extending continuously, between the projection and the second side;

the second side of the elongate body and the internal surface of the decorative portion are adjoined to form an engagement surface configured to match the adjoining interior and exterior surfaces of the wall structure;

the decorative portion and the elongate body defining a bent portion for accommodating a corner of the wall structure defined by the interior and the exterior surfaces of the wall structure; and the external surface and the internal surface are inseparable parts of the decorative portion; and the decorative portion, the door stop, the bent portion, and the elongate body are solid blocks of inseparable parts which together form an integral and monolithic, L-shaped one-piece structure.

2. The door frame component as claimed in claim 1, wherein the bent portion is a right angle bent.

3. The door frame component as claimed in claim 1, wherein the door stop forms a step on the first side with the abutment at one end.

4. The door frame component as claimed in claim 3, wherein the abutment comprises an abutment surface that is arranged transversely to the first side for engagement with a door.

5. The door frame component as claimed in claim 4, wherein the door stop includes a slot that extends inwardly from the abutment surface for accommodating a weather seal.

6. The door frame component as claimed in claim 5, wherein the slot spans along the entire length of the door stop in a direction substantially parallel to the first side of the elongate body.

7. The door frame component as claimed in claim 1, wherein the second side of the elongate body includes a groove that spans transversely along a length of the elongate body for retaining water-proof material.

8. The door frame component as claimed in claim 1, wherein the second side of the elongate body includes a groove that spans transversely along the entire length of the elongate body for retaining water-proof material.

9. The door frame component as claimed in claim 1, wherein the elongate body includes a hollow body which extends transversely through a length of the elongate body.

10. A door frame comprising:

first and second door frame components as claimed in claim 1, wherein each of the first and second door frame components has one end configured for engagement; and a third door frame component, having two engagement ends of the third door frame component, and the two engagement ends are configured for engagement with the first and second door frame components respectively.

11. The door frame as claimed in claim 10, wherein the ends of the first and second door frame components, which are configured for engagement, each comprises a chamfer to match with the respective engagement ends of the third door frame component.

12. The door frame as claimed in claim 10, wherein the one end of each of the first and second door frame components is a mirror image.

* * * * *